US008925758B2

(12) United States Patent
Benz et al.

(10) Patent No.: US 8,925,758 B2
(45) Date of Patent: Jan. 6, 2015

(54) CONTAINER FOR REFRIGERATED GOODS

(75) Inventors: Thomas Benz, Haar (DE); Jürgen Fink, Aalen (DE); Christine Linke, Gundelfingen (DE)

(73) Assignee: BSH Bosch and Siemens Hausgerate GmbH, Munich (DE)

( * ) Notice: Subject to any disclaimer, the term of this patent is extended or adjusted under 35 U.S.C. 154(b) by 729 days.

(21) Appl. No.: 11/919,723

(22) PCT Filed: Apr. 6, 2006

(86) PCT No.: PCT/EP2006/061384

§ 371 (c)(1),
(2), (4) Date: Oct. 30, 2007

(87) PCT Pub. No.: WO2006/120101

PCT Pub. Date: Nov. 16, 2006

(65) Prior Publication Data

US 2009/0071966 A1 Mar. 19, 2009

(30) Foreign Application Priority Data

May 10, 2005 (DE) ..... 10 2005 021 588

(51) Int. Cl.
*B65D 6/28* (2006.01)
*F25D 25/00* (2006.01)
*F25D 25/02* (2006.01)

(52) U.S. Cl.
CPC ..... *F25D 25/005* (2013.01); *F25D 25/025* (2013.01); *F25D 2400/18* (2013.01)
USPC ..... 220/617; 220/592.01; 220/592.02; 220/615; 220/770; 220/771; 312/348.2; 312/348.4

(58) Field of Classification Search
USPC ..... 220/62.13, 62.22, 592.01, 592.02, 615, 220/617, 675, 682, 770, 771; 312/348.4, 312/401, 402, 404, 348.1, 348.2, 406.2
See application file for complete search history.

(56) References Cited

U.S. PATENT DOCUMENTS

| | | | | |
|---|---|---|---|---|
| 3,901,572 | A * | 8/1975 | Litchfield | 312/348.2 |
| 4,128,284 | A * | 12/1978 | King | 312/348.2 |
| 4,560,072 | A | 12/1985 | Burrell | |
| 5,437,503 | A | 8/1995 | Baker et al. | |
| 5,618,091 | A * | 4/1997 | Huber et al. | 312/348.1 |
| 2005/0210655 | A1 * | 9/2005 | Lyvers | 29/527.1 |

FOREIGN PATENT DOCUMENTS

| | | |
|---|---|---|
| JP | 8-226751 | 9/1996 |
| WO | WO 95/12099 | 5/1995 |

OTHER PUBLICATIONS

International Search Report PCT/EP2006/061384.

* cited by examiner

*Primary Examiner* — Jeffrey Allen
*Assistant Examiner* — Madison L Poos
(74) *Attorney, Agent, or Firm* — Nixon & Vanderhye P.C.

(57) ABSTRACT

The invention relates to a container for refrigerated goods. The container includes a body part and a front part coupled to the body part. The front part is formed by a pair of side pieces and at least one central piece extending to and connected to the side pieces. The central piece has a constant cross-sectional shape.

19 Claims, 2 Drawing Sheets

Fig. 1
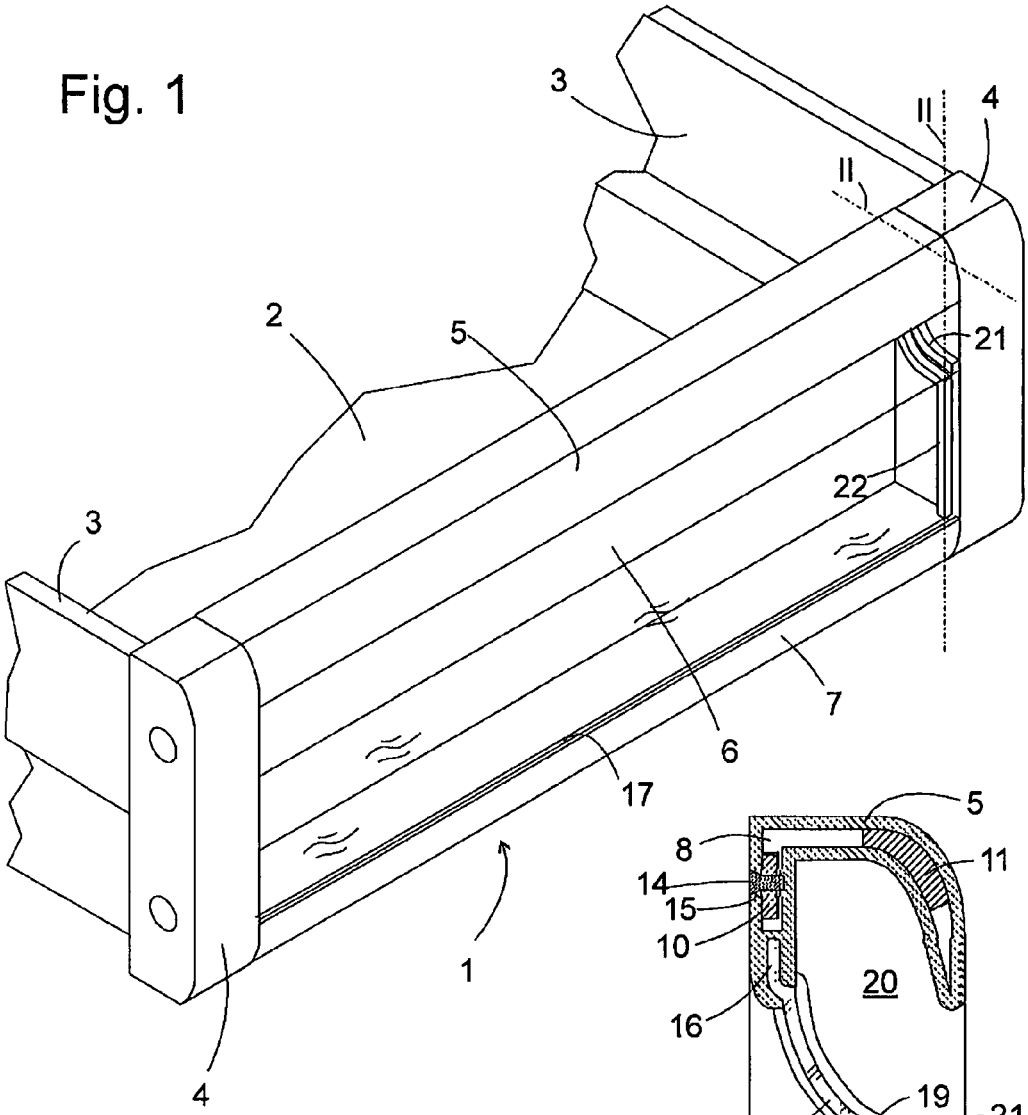
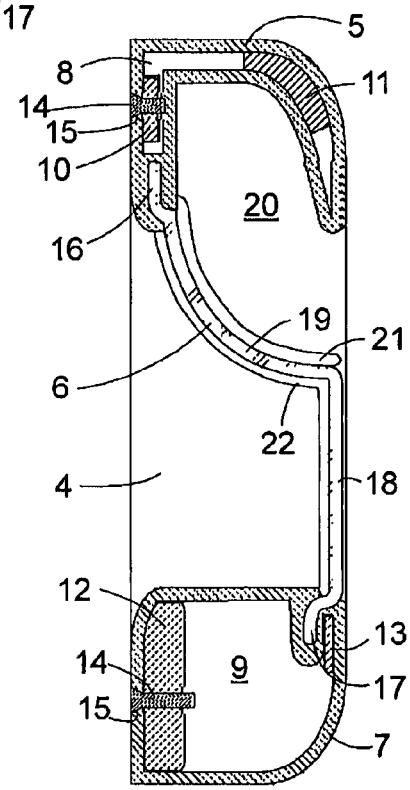
Fig. 2

CONTAINER FOR REFRIGERATED GOODS

The present invention relates to a container for refrigerated goods for use in a refrigerating device, and in particular the front part of such a container for refrigerated goods.

BACKGROUND OF THE INVENTION

Pull-out containers for refrigerated goods, which may be used for example as salad drawers in a refrigerating device, are usually injection-molded from plastic. In the production of these one-piece containers, specific, large-sized and therefore costly molding tools are required for each individual container type. The variation between different container models is often not in their dimensions, but only in the design of their front part, the cost of which varies depending on the value of the appliance. It has therefore already been proposed that containers for refrigerated goods should be equipped with interchangeable front parts, so that a container with the same basic form might be implemented with different outward appearances.

Refrigerated goods containers made from sheet metal are used in large-size refrigerating devices, since sufficient structural stability cannot easily be guaranteed with long edge lengths. However, metal containers are more expensive to manufacture since they must be assembled from different parts in several production stages.

SUMMARY OF THE INVENTION

The object of the present invention is to create a front wall for a container for refrigerated goods, or a container for refrigerated goods, which can be easily and economically manufactured in a number of different sizes without different molding tools being required in each instance for the different sizes.

The object is achieved by a front part for a container for refrigerated goods, which is assembled from side pieces and at least one central piece which connects said side pieces. The multi-sectional construction of the front wall for a container for refrigerated goods, in particular a salad drawer, enables different design variants to be created cost-effectively. In addition, materials of varying quality and different materials may be used in combination for the front wall and the container for refrigerated goods.

Because of its constant cross-sectional form, the central piece may be cut to any length as required for a specified format of a container for refrigerated goods and fitted to the completed front part, regardless of its length, and always with the same side pieces.

The central piece may be produced easily and economically by extrusion, whilst the side pieces are preferably injection-molded.

A requisite joint with high tensile strength between the central piece and a side piece is preferably created whereby the side piece has one surface that is oriented lengthwise to the central piece and is in contact with the central piece, and whereby a pin is accommodated in the drill holes going through the surface of the side and central pieces.

For this purpose, the central piece preferably has a cavity and the surface of the side piece that is in contact with the central piece is molded—invisibly from the outside—on a peg of the side piece, said peg being inserted into the cavity.

Furthermore, it is advantageous for the front part to comprise an upper, mid and lower central piece. This simplifies the manufacture of front parts of differing heights, since only the side pieces and the central piece are manufactured for a certain height of the front piece for specific versions, whilst the same upper and lower central piece may be used with front parts of differing heights.

In such a case the joint with high tensile strength is advantageously formed between the side pieces and the upper and lower central piece respectively.

A simple tongue and groove joint with an adjacent side or central piece is sufficient to fix the mid central piece.

A tongue and groove joint between the mid central piece and the upper and/or lower central piece is preferably interlocking, in order to improve the stability of the front part.

In order to form a handle for the front part, the upper central piece is preferably designed as a downward-opening U-profile, and a part of the mid central piece that runs diagonally downward and to the front surface of the front piece joins onto one of the sides of the U-profile facing the rear side of the front part.

The various pieces of the front part may be manufactured from at least two different materials. Thus a transparent plastic, which enables the interior of the container for refrigerated goods to be viewed, may expediently be used for the mid central piece, whilst a non-transparent material, which may likewise be a plastic, or a metal such as steel or aluminum, is preferred for the side pieces and/or the upper or lower central piece.

According to the invention, a container for refrigerated goods is assembled from a container part, which comprises side walls, a floor and a rear wall, and a front part as described above.

The said container part and the front part are preferably joined to each side wall with the help of at least one projecting part, which is inserted into a recess in a side piece and is locked into said side piece by a pin oriented transversely to the direction of insertion.

Other features and advantages of the invention ensue from the following description of exemplary embodiments with reference to the attached diagrams, in which

BRIEF DESCRIPTION OF THE DRAWINGS

FIG. 1 shows a perspective view of a front part according to the invention, and a part of a container for refrigerated goods to which the front part is mounted;

FIG. 2 shows a cross-section through the front part; and

DETAILED DESCRIPTION OF THE EXEMPLARY EMBODIMENTS OF THE PRESENT INVENTION

Figure 3:
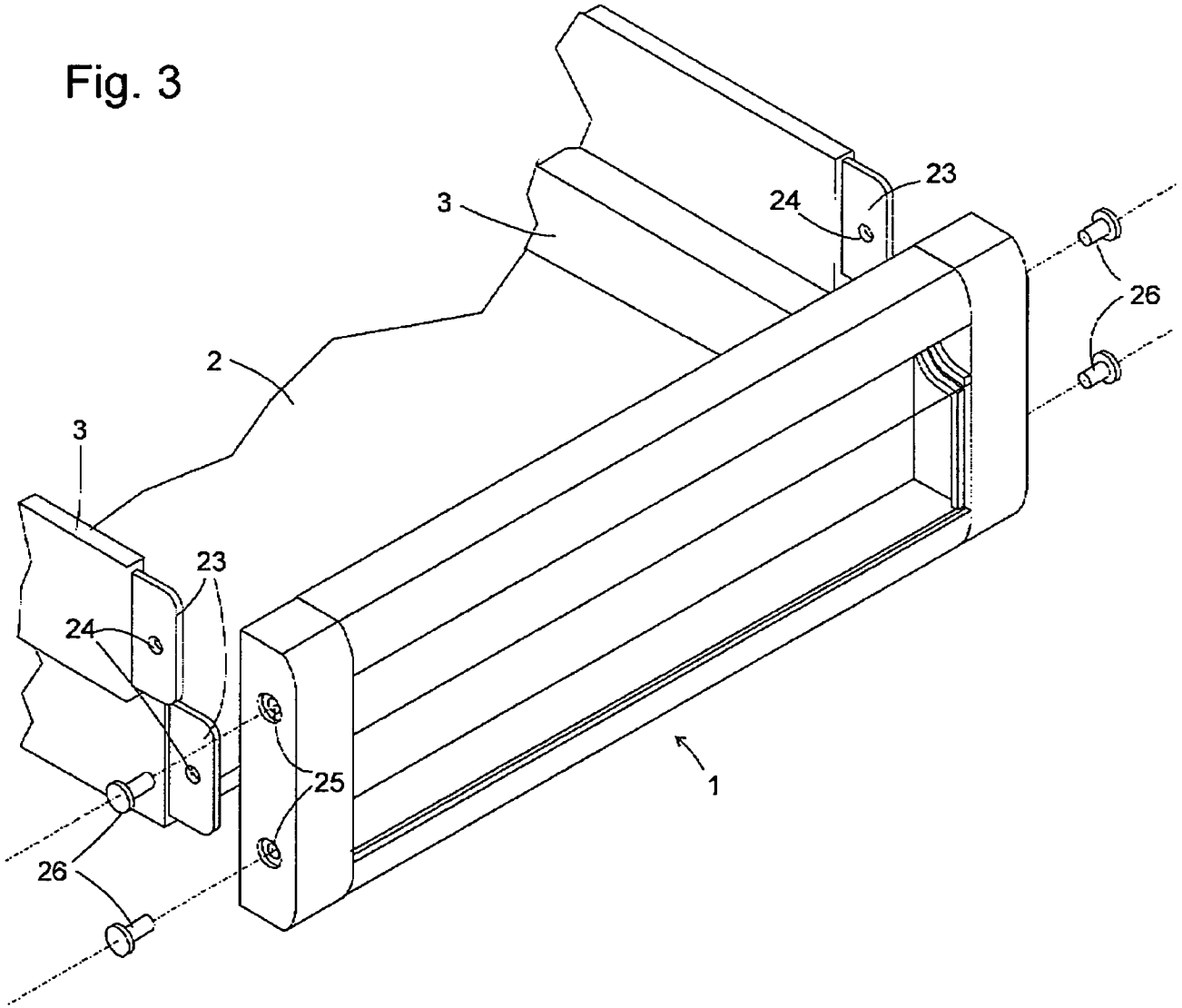
FIG. 3 shows the container for refrigerated goods, dismantled into the front part and a container part behind it.

FIG. 1 is a perspective view of the front area of a container for refrigerated goods according to this invention. The container has a front part 1 which serves as the front wall, to which are adjoined a floor 2 and side walls 3; a rear wall is not shown in the diagram.

The front part 1 is assembled in modular form from five pieces, two injection-molded side pieces 4 and three central pieces, which are labeled from top to bottom as 5, 6 and 7. The central pieces 5 to 7 are all extruded parts, i.e. parts that have a cross-sectional form that remains constant lengthwise and can therefore be cut to any length as required. One set of molding tools is therefore sufficient for the side pieces 4 and the central pieces 5 to 7, in order to manufacture front parts 1 in as many different widths as required.

FIG. 2 shows a cross-section through the front part 1 at a level labeled in FIG. 1 by lines II. It may be seen that the upper and the lower central pieces 5 and 7 are each hollow sections, and that pegs 10, 11, 12, 13, which protrude in one piece from the side pieces 4, extend by a few centimeters into the inner cavities 8 and 9 of said hollow sections. The pegs 10 to 13 are placed in the cavities 8, 9 in such a way that they touch the opposite walls and therefore fix the position of the central pieces 5, 7 in relation to the side pieces 4 such that their outer surfaces are connected flush with one another.

Two screws 14 are inserted respectively through bore holes 15 in the rear wall of the central pieces 5, 7 into screw threads in the pegs 10 and 12 respectively and thus fix the central pieces 5, 7 to the side piece 4.

The mid central piece 6, which is molded in a single panel from transparent plastic, comprises a vertical wall 18 which is flush with the front edges of the side pieces 4 and, joined at the top to the vertical wall 18, a curved wall piece 19 which curves upward and to the rear of the front part 1, in order finally to interlock into a groove 16 in the upper central piece 5. The curved wall piece 19 and the U-shaped upper central piece 5 thus form a handle groove 20 which is open on the front edge of the front part 1, so that a user can reach into it in order to pull out the container for refrigerated goods.

The vertical wall 18 and the curved wall piece 19 are fixed to the side pieces 4 with the help of projecting ridges 21, 22 a few millimeters wide, on which the lateral edge of the wall 18 rests and between which the lateral edge of the wall piece 19 fits. The lower edge of the central piece 6 interlocks in turn into a groove 17 in the lower central piece 7.

The front part 1 is assembled by firstly attaching the upper and lower central piece 6, 7 to the pegs 10 to 13 of a side piece 4. In this position it is possible for the mid central piece 6 to be inserted sideways into the grooves 16, 17; the second side piece 4 is then attached and the individual parts are fixed to one another with the help of screws 14.

As may be seen from the opened out illustration in FIG. 3, the side walls 3 each have two projecting parts 23, which are provided in order to be inserted into a recess in the open rear edge of the side piece 4, so that holes 24 in the projecting parts 23 are aligned with sink holes made in the outer edges of the side pieces 4. By inserting locking pins 26 into the sink holes 25 and the holes 24 in the projecting parts 23, the front part 1 is locked to the side walls 3.

In order to manufacture front parts with different heights, it is sufficient for the side pieces 4 and the mid-central piece 6 respectively to be manufactured in a mold specific for the height required in each case; the upper and lower central pieces 5, 7 may be used in the same form on front parts.

Depending on the required appearance and value or even the dimensions of the refrigerating device in which the finished container for refrigerated goods is used, different materials may be used for the various components of the container for refrigerated goods. Thus the rear part of the container for refrigerated goods can simply be injection-molded from plastic, or—if required or necessary due to large dimensions—may be molded or joined from sheet metal. In the same way, the side pieces 4 and the lower central piece 7 may consist of metal or plastic as required. In the upper central piece 6 an embodiment of metal-coated plastic is preferable to an embodiment made entirely from metal, to prevent a user's fingers from becoming frozen to the central piece 5 in temperatures below 0° C.

The invention claimed is:

1. A container for refrigerated goods, the container comprising:

a.) a body part; and b.) a front part coupled to the body part, the front part being formed by a pair of side pieces and at least one central piece extending to and connected to the side pieces, wherein the central piece includes an upper portion, a mid portion, and a lower portion, wherein the upper portion of the central piece has a downward-opening U-profile including first and second leg portions at least partially defining a handle groove area therebetween to receive a user's hand, wherein the first leg portion of the U-profile is arranged relatively proximal a front side of the front part and the second leg portion of the U-profile is arranged relatively distal the front side of the front part, wherein the mid portion of the central piece has a first end portion thereof attached to the second leg portion of the U-profile and a second end portion thereof attached to the lower portion of the central piece so as to permit access to the handle groove area between the first and second leg portions of the U-profile, wherein each of the side pieces of the front part has one surface that is oriented lengthwise to the central piece and in contact with the central piece, wherein each of the side pieces of the front part has a first bore extending in a direction transverse to a length of the central piece, wherein the central piece of the front part has a second bore extending in the direction transverse to the length of the central piece and corresponding to the first bore of one of the side pieces, and wherein each of the respective interconnections between each of the side pieces of the front part and the central piece of the front part includes a pin accommodated in one of the first bore of one of the side pieces of the front part and the second bore of the central piece of the front part.

2. The container for refrigerated goods as claimed in claim 1, wherein the central piece has a constant cross-sectional shape.

3. The container for refrigerated goods as claimed in claim 1, wherein the central piece is configured as an extruded section.

4. The container for refrigerated goods as claimed in claim 1, wherein the side pieces are formed of injection-molded material.

5. The container for refrigerated goods as claimed in claim 1, wherein the central piece of the front part has a cavity, each of the side pieces of the front part has a peg that is received in the cavity of the central piece of the front part, and a surface in contact with the central piece of the front part is molded on one of the pegs of the side pieces of the front part that is received in the cavity of the central piece of the front part.

6. The container for refrigerated goods as claimed in claim 1, wherein a connection with high tensile strength is formed respectively between each of the side pieces of the front part and the upper portion and the lower portion of the central piece of the front part.

7. The container for refrigerated goods as claimed in claim 1, wherein the mid portion of the central piece of the front part is connected to the upper portion of the central piece of the front part and the lower portion of the central piece of the front part via a tongue and groove joint.

8. The container for refrigerated goods as claimed in claim 7, wherein a tongue and groove joint between at least one of the mid portion of the central piece of the front part and the upper portion of the central piece of the front part and the lower portion of the central piece of the front part is form-locking.

9. The container for refrigerated goods claimed in claim 1, wherein a segment of the mid portion of the central piece of the front part includes a diagonally downwardly extending segment which extends diagonally downwardly from the second leg portion of the U-profile and to a front edge of the mid portion of the central piece.

10. The container for refrigerated goods as claimed in claim 1, wherein the side pieces of the front part and the central piece of the front part are formed from at least two different materials.

11. The container for refrigerated goods as claimed in claim 1, wherein the body part includes side walls, a floor, and a rear wall.

12. The container for refrigerated goods as claimed in claim 11, wherein each side wall of the body part has at least one projecting segment that is received in a recess in a side piece and the projecting segment is locked into the recess by a pin oriented transversely to the direction of insertion.

13. A refrigerating device, comprising:

a drawer space; and the container of claim 1, wherein the container is positioned in the drawer space.

14. A container for refrigerated goods, the container comprising:

a body part including side walls, a floor, and a rear wall; and a front part coupled to the body part, wherein the front part includes:

a first side piece;

a second side piece; and a central piece having a first end connected to the first side piece and a second end connected to the second side piece, wherein the central piece of the front part includes an upper portion, a mid portion, and a lower portion, wherein the upper portion of the central piece of the front part has a downward-opening U-profile including first and second leg portion at least partially defining a handle groove area therebetween to receive a user's hand, wherein the mid portion of the central piece of the front part includes a diagonally downwardly extending segment which extends to a front edge of the mid portion of the central piece, wherein the diagonally downwardly extending segment is attached to one of the first and second leg portions of the U-profile of the upper portion of the central piece of the front part so as to permit access to the handle groove area between the first and second leg portions of the U-profile, wherein each of the side pieces of the front part has one surface that is oriented lengthwise to the central piece and in contact with the central piece, wherein each of the side pieces of the front part has a first bore extending in a direction transverse to a length of the central piece, wherein the central piece of the front part has a second bore extending in the direction transverse to the length of the central piece and corresponding to the first bore of one of the side pieces, and wherein each of the respective interconnections between each of the side pieces of the front part and the central piece of the front part includes a pin accommodated in one of the first bore of one of the side pieces of the front part and the second bore of the central piece of the front part.

15. The container of claim 14, wherein the mid portion of the central piece of the front part is connected to an adjacent side portion of the upper portion of the central piece of the front part and the lower portion of the central piece of the front part via a tongue and groove joint.

16. The container of claim 14, wherein the side pieces of the front part and the central piece of the front part are formed from at least two different materials.

17. The container of claim 14, wherein each side wall of the body part has at least one projecting segment that is received in a recess in a side piece and the projecting segment is locked into the recess by a pin oriented transversely to the direction of insertion.

18. The container of claim 14, wherein the first leg portion of the U-profile is arranged relatively proximal a front side of the front part and the second leg portion of the U-profile is arranged relatively distal the front side of the front part, and the diagonally downwardly extending segment is attached to the second leg portion, and wherein the first leg portion is configured to be gripped by the user to pull out the container from a drawer space.

19. A refrigerating device, comprising:

a drawer space; and the container of claim 14, wherein the container is positioned in the drawer space.

* * * * *